US005248096A

United States Patent [19]

Hoey et al.

[11] Patent Number: 5,248,096

[45] Date of Patent: Sep. 28, 1993

[54] AIR BRUSH

[75] Inventors: Dennis S. Hoey, Los Angeles; John F. Corbani, Santa Barbara, both of Calif.

[73] Assignee: Medea Trading Company, Inc., Portland, Oreg.

[21] Appl. No.: 794,727

[22] Filed: Nov. 15, 1991

[51] Int. Cl.[5] ..... B05B 7/30; B05B 11/04

[52] U.S. Cl. ..... 239/272; 239/71; 239/104; 239/288.3; 239/305; 239/309; 239/328; 239/340; 239/418; 239/433; 239/525; 604/296

[58] Field of Search ..... 239/8, 71, 74, 104, 239/106, 309, 305, 306, 328, 340, 375, 418, 433, 525, 288, 288.3, 599, 271, 272; 604/289, 310, 290, 296; 222/637, 630, 82, 105

[56] References Cited

U.S. PATENT DOCUMENTS

| | | | |
|---|---|---|---|
| 1,482,747 | 2/1924 | Howe | 604/290 |
| 2,593,552 | 4/1952 | Folkman | 239/309 |
| 3,084,870 | 4/1963 | Hagadorn | 239/305 |
| 3,119,561 | 1/1964 | Wilson | 239/309 |
| 3,198,442 | 8/1965 | Brenner | 239/599 |
| 3,780,950 | 12/1973 | Brennan | 239/309 |
| 4,079,893 | 3/1978 | Bass | 239/375 |
| 4,357,937 | 11/1982 | Burrell, Jr. et al. | 604/289 |

FOREIGN PATENT DOCUMENTS

| | | | |
|---|---|---|---|
| 2258193 | 9/1975 | France | 239/340 |
| 2177620 | 1/1987 | United Kingdom | 239/340 |

*Primary Examiner*—Andres Kashnikow
*Assistant Examiner*—Karen B. Merritt
*Attorney, Agent, or Firm*—Robert L. Harrington

[57] ABSTRACT

An air brush is shown and described having separate gas delivery and media delivery portions whereby different media delivery portions may be provided with alternate media or media colors and selectively mounted upon the gas delivery portion. The media delivery portion includes an airless media sack which collapses upon delivery of media from the media delivery portion. By separating the gas delivery and media portions in the manner of the present invention, a user can quickly switch between media or media color without an intermediate cleaning step. The air brush of the present invention further provides freedom of spray direction including horizontal and vertical spraying. Both artistic and medical uses of the air brush are illustrated.

22 Claims, 5 Drawing Sheets

FIG. 1
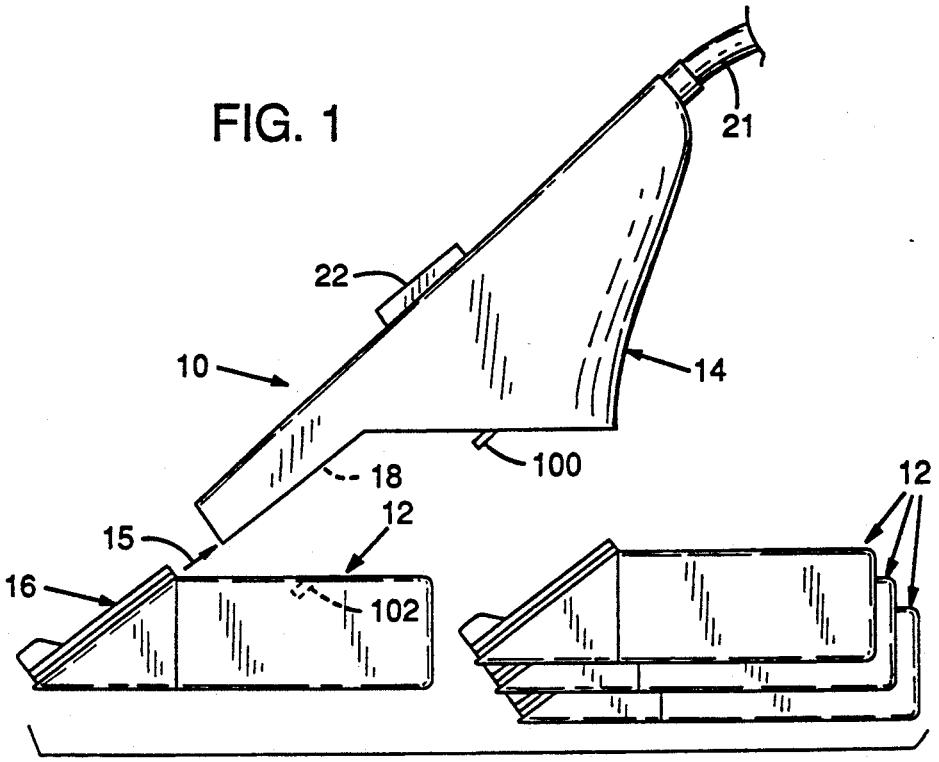
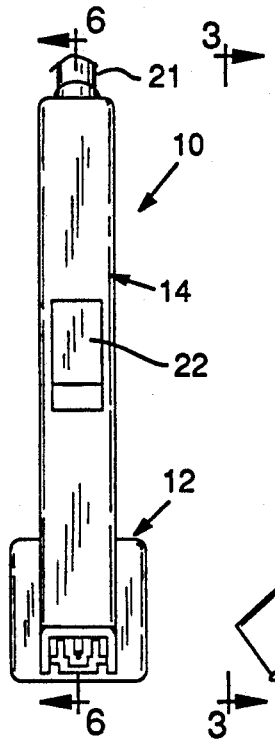
FIG. 3
FIG. 2
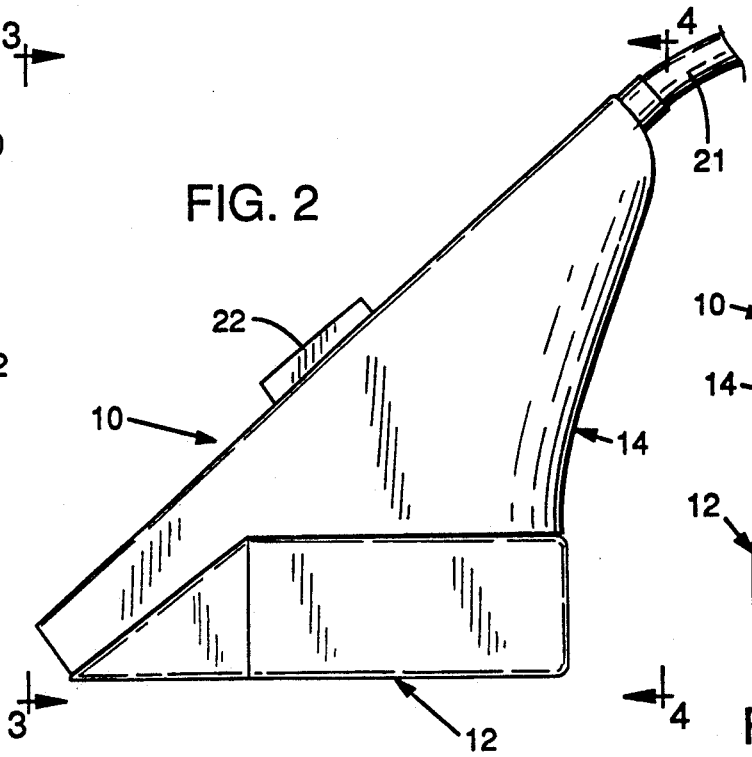
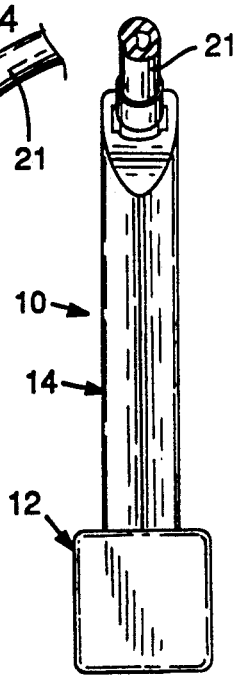
FIG. 4

AIR BRUSH

BACKGROUND OF THE INVENTION

This invention relates generally to media delivery apparatus, and particularly to air brush media delivery systems.

An air brush as used for a media delivery system is characterized by a compressed air source and a media source integrated into a hand held device. The compressed air source is typically an air compressor delivering compressed air by way of hose to the air brush and an intricate set of passageways through the structure of the air brush including a valve for controlling flow of compressed air. The media source is typically a cup-like container for providing a reservoir of media which flows down through passageways of the air brush. Upon actuation of a spray button, a needle valve releases a flow of media near the outlet of the air brush body while concurrent therewith a source of compressed air is released by valve actuation to provide an air flow around and past the needle valve outlet. The air flow draws media from the needle valve outlet and the media is atomized as it exits the body of the air brush within the air flow. In operation, the user depresses the spray button while moving the device in a desired pattern to produce the atomized spray and desired media coverage.

Such hand held air brushes are generally complicated mechanical devices including intricate passageways for delivering media and compressed air and requiring various lever and spring assemblies responsive to actuation of the spray button to produce the desired media flow and air stream at the outlet of the air brush. Such mechanical complexity contributes to a generally expensive item.

Because the media and air intermix within the body of the air brush, an air brush requires an intermediate cleaning step between use of different media or media colors. More particularly, because the media is introduced into the air stream within the air brush at the needle valve outlet, the air brush structure becomes contaminated with each media or media color used and must be cleaned before a new media or color can be used.

Air brushes are typically used in elaborate art work requiring fine control over media delivery and, in many cases, many different media or many media colors in a single project. Cleaning is particularly burdensome in such use of an air brush because the artist often must apply a great number of colors before the work is complete and for each color change an intermediate cleaning step is required.

It would, therefore, be desirable for an air brush to be less complicated to use, less expensive and permit more convenient switching between media or media color.

SUMMARY OF THE INVENTION

A preferred embodiment of the present invention in a first aspect is an air brush including as a separate media delivery system a self contained media cartridge with an airless media sack coupled to a media nozzle. This aspect of the invention provides convenient switching among media cartridges, e.g. to provide different colors, without an intermediate cleaning step. The cartridge may be disposable and provided by the manufacture pre-filled with media whereby the user need not handle the media directly.

A preferred embodiment of the present invention in a second aspect is an air brush including a self contained media cartridge with a media sack and a one way valve between the sack and a media nozzle. This aspect of the invention provides freedom of spray direction including vertical and horizontal spray directions.

In a third aspect, the present invention may be adapted to provide a two piece self contained media cartridge. In this embodiment of the present invention, a nose portion of the cartridge couples to the air brush and provides a media delivery point relative to a gas stream, e.g., an air stream, provided by the air brush. A media compartment portion of the cartridge includes an airless media sack having as its outlet a sealed membrane adapted for penetration by a protruding needle of the nose portion. To use the media cartridge of this embodiment, the media compartment portion is mounted upon the nose portion while inserting the needle through the membrane whereby media flows through the needle and into the nose portion. Thus, one nose portion may be used with several media compartment portions.

In another aspect, the preferred embodiment of the present invention provides an air brush having a gas, e.g., air, delivery system and a separate media delivery system. Multiple media delivery systems containing, for example different colors or media, are then selectively mounted upon the gas delivery system and disposable upon exhausting the media supply therein. Each media delivery system comprises a cartridge with an airless media sack and if needed a one way valve between the sack and a media nozzle. The gas delivery system includes, in an air based system, an air nozzle and mounting means for the cartridge which positions the media nozzle suitably adjacent the air nozzle. Media is drawn from the media cartridge into an air flow provided by the air nozzle and past the media nozzle, but the gas delivery portion is not contaminated by the media. The artist can thereby quickly switch between colors or media without an intermediate cleaning step.

In yet another aspect of the present invention, an air brush is used to apply in controlled fashion medication to an injury. As used in medical applications, the air brush may be provided in many of the above-noted configurations, but adapted for delivering medication to a wound site. In the medical application, the gas delivery system may be more appropriately configured to deliver, for example, nitrogen gas; more suitable than air for application of the medication to an open wound site.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which:

FIG. 1 is a side view of an air brush according to a preferred embodiment of the present invention and showing separated the air delivery portion and a plurality of media delivery portions each selectively mountable upon the air delivery portion.

FIGS. 2–4 show side, front and rear views, respectively, of the air brush of FIG. 1 with the air delivery and a media delivery portion joined for use of the air brush.

DETAILED DESCRIPTION OF THE PREFERRED EMBODIMENT

Figures 5, 6:
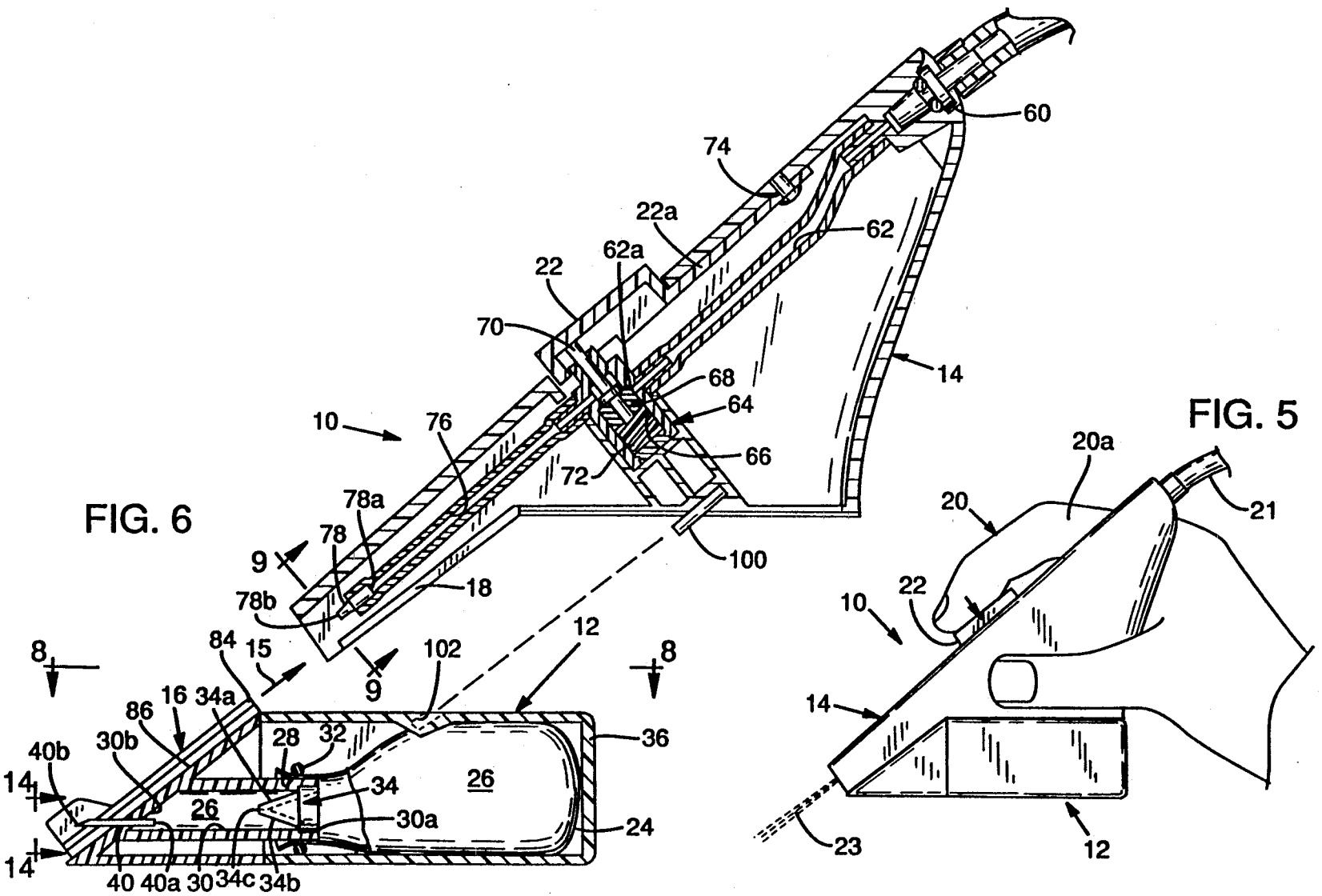
FIG. 5 illustrates use of the air brush of FIG. 1.
FIG. 6 is a sectional view, as taken along lines 6—6 of FIG. 3, but with the air delivery and media delivery portions separated.

The preferred embodiment of invention as illustrated in the drawings is an air brush 10 comprising a media delivery portion 12 and an air delivery portion 14. Several additional media delivery portions 12 are shown in FIG. 1, each containing different media or media color for quickly switching between media or media colors. In this regard, the air brush 10 provides the artist with quick media color change capability for switching between the many colors typically used in a single air brush work. Also, the cartridges may be disposable and provided prefilled so that the artist need not handle the media directly. The artist switches between such media delivery portions 12 by detachment and attachment to the air delivery portion 14 without an intermediate cleaning step. Each delivery portion 12 includes a coupling formation 16 corresponding to a coupling formation 18 of air delivery portion 14 for slidably joining portions 12 and 14 as indicated by arrow 15 in FIG. 1. The artist thereby enjoys less maintenance steps between media or color changes and works more efficiently.

FIG. 2 shows the air brush 10 with a media delivery portion 12 mounted upon the air delivery portion 14. FIGS. 3 and 4 show front and rear views, respectively, of the air brush 10 illustrating the overall configuration and appearance of the air brush 10. FIG. 5 shows use of the air brush 10 wherein an artist's hand 20 grips the air brush by grasping the air delivery portion 14 between the thumb and fingers, wrapping the index finger 20*a* about air delivery portion 14, and engaging a spray button 22. Air brush 10 receives compressed gas, e.g., compressed air, from air hose 21 and, in response to actuation of spray button 22, delivers a stream of air past a media nozzle of the media delivery portion 12 to draw media therefrom and produce the media spray 23. While the illustrated embodiment is shown as adapted for coupling to a compressed air source, it will be understood that other compressed gases may be used in the air brush 10 to accomplish the atomization of media and delivery of that media in a desired spray pattern. While shown directing the spray 23 in a substantially down and leftward direction, the view of FIG. 5, air brush 10 has the capability of spraying in a variety of directions including vertically upward and horizontally.

FIG. 6 is a sectional view of the media delivery portion 12 and air delivery portion 14 taken along lines 6—6 of FIG. 3. In FIG. 6, media delivery portion 12 includes an airless media sack 24 containing liquid ink media 26. The illustrated embodiment is adapted for use with water based ink products as media 26, but it should be apparent that other media may be used. Because the sack 24 is airless, the media 26 does not dry within the sack 24. The sack opening 28 mounts upon a conduit 30 of media delivery portion 12. Specifically, an open end 30*a* of conduit 30 receives on its outer surface the sack opening 28 and an O ring 32 secures sack opening 28 upon the exterior of conduit 30. A one way valve 34 positioned at the open end 30*a* of conduit 30 allows media 26 to flow from sack 24 into conduit 30, but not back into sack 24. The one way valve 34 must permit media flow into conduit 30 in response to very low pressure differential between the interior of conduit 30 and sack 24. Thus, sack 24 is adapted to collapse upon dispersal of media therefrom. A suitable one way valve 34 has been provided by a soft rubber material forming two inclined surfaces 34*a* and 34*b* and a slit opening 34*c* at the juncture of surfaces 34*a* and 34*b*. A protective enclosure 36 of portion 12 protects sack 24 against puncture or unintended compression during use of air brush 10.

A tubular nozzle 40 couples the interior of conduit 30 with the exterior of media delivery portion 12. More particularly, the tubular nozzle 40 extends through the closed end 30*b* of conduit 30 for delivering media 26 externally of media delivery portion 12. An interior end 40*a* of nozzle 40 rests within conduit 30 and the opposite end 40*b* provides a nozzle outlet for the media delivery portion 12. In the illustrated embodiment, the nozzle 40 has an inner diameter of 0.62 millimeters and the end 40*b* is cut at a 45 degree angle. Media 26 is drawn from media delivery portion 12 by positioning end 40*b* of nozzle 40 within a stream of compressed air exiting air brush 10. This stream of air draws media 26 from nozzle 40 to disperse media 26 and provide the media spray 23 (FIG. 5) in a desired consistency.

Air delivery portion 14 includes an air hose coupling 60 for attachment to the air hose 21 (FIGS. 1–5). Compressed gas, in the illustrated embodiment compressed air provided at 15 to 20 pounds per square inch, entering air delivery portion 14 travels along air conduit 62 to a valve 64. Valve 64 includes a cylinder 66 in which a piston 68 rests slidably. A push rod 70 moves piston 68 toward an open valve position, down and to the right in FIG. 6, and a spring 72 urges piston 68 in the opposite direction toward a closed valve position. Fastener 74 mounts a flexible tongue 22*a* of spray button 22 to the body of air delivery portion 14. The distal portion, i.e. finger engaging portion, of spray button 22 rests in cantilevered fashion above push rod 70 for engaging push rod 70. Actuation of spray button 22 thereby moves piston 68 to the open valve position.

In the open valve position, piston 68 allows compressed air into the cylinder 66. Air conduit 76 couples the cylinder 66 and air nozzle 78. Air nozzle 78 includes an inlet **78*a* mounted within conduit 76 and an outlet 78*b* adapted for discharge of compressed air from air delivery portion 14. In the illustrated embodiment, the nozzle end 78*b* has an inner diameter of 0.60 millimeters and is cut square relative to the longitudinal axis of nozzle 78**.

Figure 7:
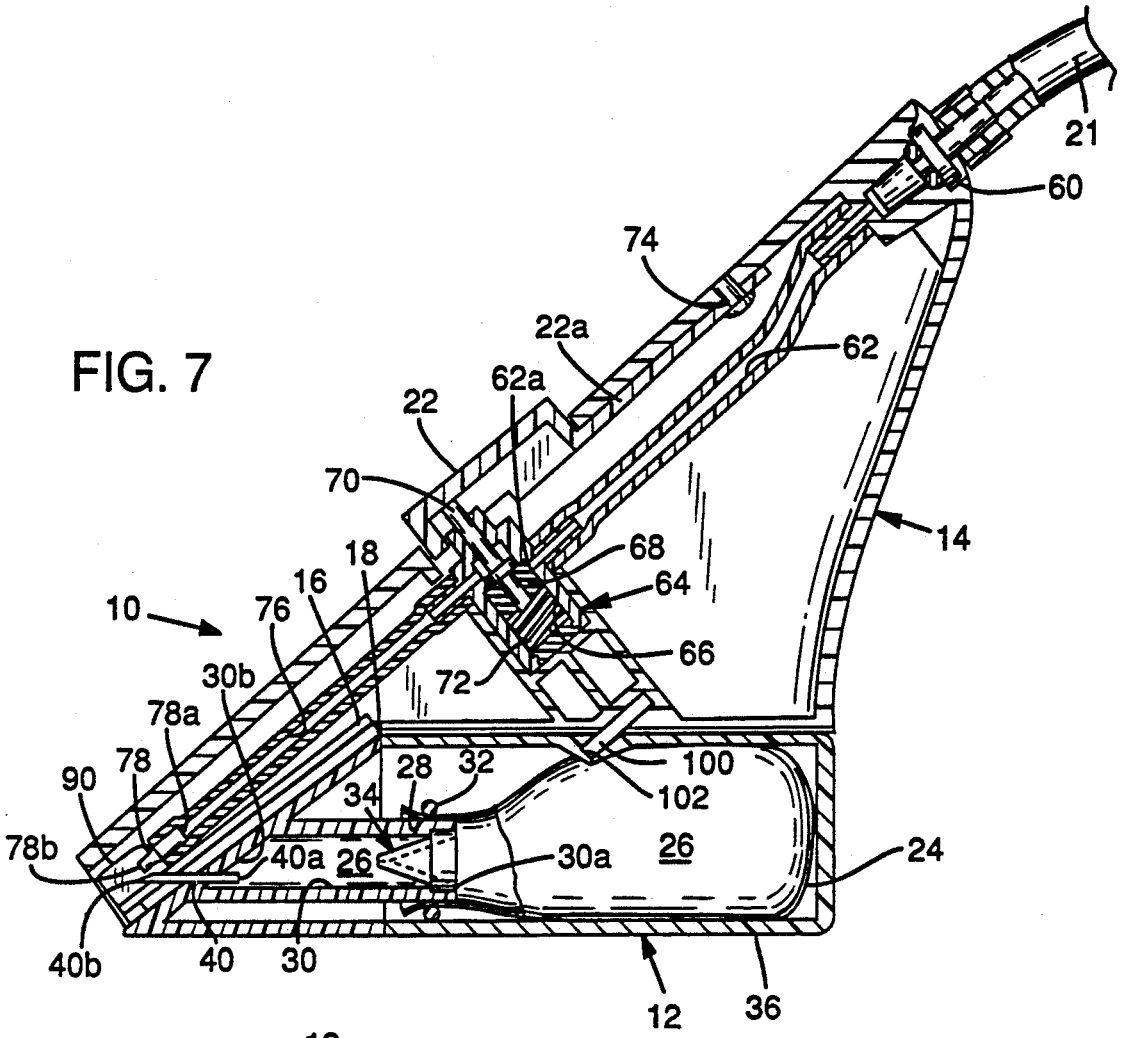
FIG. 7 is a sectional view similar to FIG. 6, but showing the air delivery and media delivery portions joined for use.

As shown in FIG. 7, when media delivery portion 12 mounts upon air delivery portion 14, the air nozzle 78 is positioned with respect to the media delivery nozzle 40, i.e. sufficiently close to direct an air flow across nozzle **40*b* and draw media 26 from media delivery portion 12. Thus, upon actuation of spray button 22 by the artist's index finger 20*a* (FIG. 5) spray button 22 engages push rod 70 to introduce compressed air into the cylinder 66, along conduit 76, and out nozzle 78 to draw media 26 from nozzle 40 and produce the media spray 23 (FIG. 5**).

Figure 8:
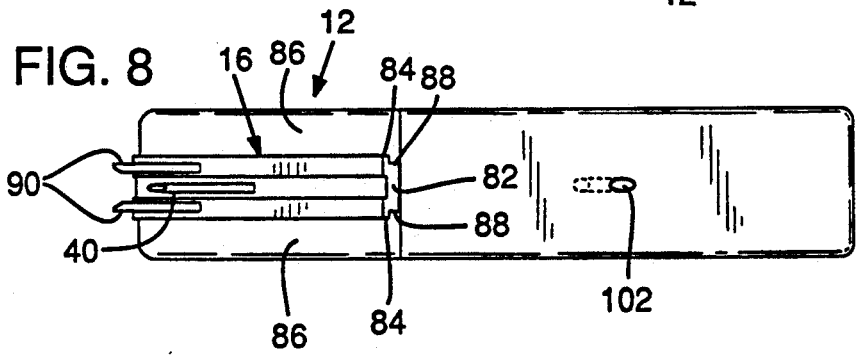
FIG. 8 is a top view of the media delivery portion of the air brush taken along lines 8—8 of FIG. 6 and showing a mounting structure therefor.

FIG. 8 illustrates the coupling formation 16 of media delivery portion 12. In FIG. 8, coupling formation 16 includes a base 82 attached to a leading inclined surface 86 of media delivery portion 12. Base 82 carries a pair of outward extending rails 84 whereby rails 84, base 82 and surface 86 define a pair of parallel outward directed groove formations 88 of media delivery portion 12. Also, a pair of guard plates 90 are positioned on each side of the exposed end **40*b* of media nozzle 40 for protecting the delicate nozzle 40 from damage when media delivery portion 12 is separate from air delivery portion 14. Mounting of media delivery portion 12 is further secured upon air delivery portion 14 by a registration peg 100 extending from the undersurface of air delivery portion 14 and positioned to enter a peg receiving aperture 102 of media delivery portion 12**.

Figure 9:
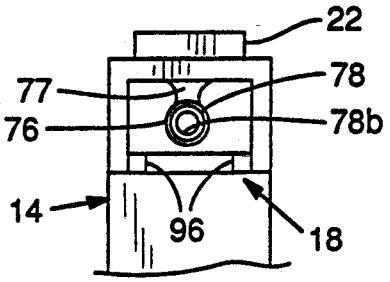
FIG. 9 is a sectional view, taken along lines 9—9 of FIG. 6, showing a mounting structure of the air delivery portion for receiving the mounting structure of the media delivery portion.

With reference to FIG. 9, air delivery portion 14 includes as coupling formation 18 a pair of inward directed rails 96 adapted for insertion within the groove formations 88 of media delivery portion 12. Media delivery portion 12 thereby slidably mounts upon air delivery portion 14 by introducing the rails 96 of portion 14 into the groove formations 88 of portion 12 and moving portion 12 up against the body of portion 14 as indicated by arrow 15 of FIGS. 1 and 6. As portion 12 comes to abut portion 14, registration peg 100 enters aperture 102 and media delivery portion 12 is secured upon air delivery portion 14. In so mounting portion 12 upon portion 14, the outlet end **40*b* of media nozzle 40 must be positioned consistently relative to the outlet end 78*b* of air nozzle 78. The conduit 76 is supported by a rib 77 along the length of conduit 76 for secure positioning of nozzle 78 relative to mounting structure 18, and therefore relative to nozzle 40*b* upon mounting of portion 12**.

Figure 10:
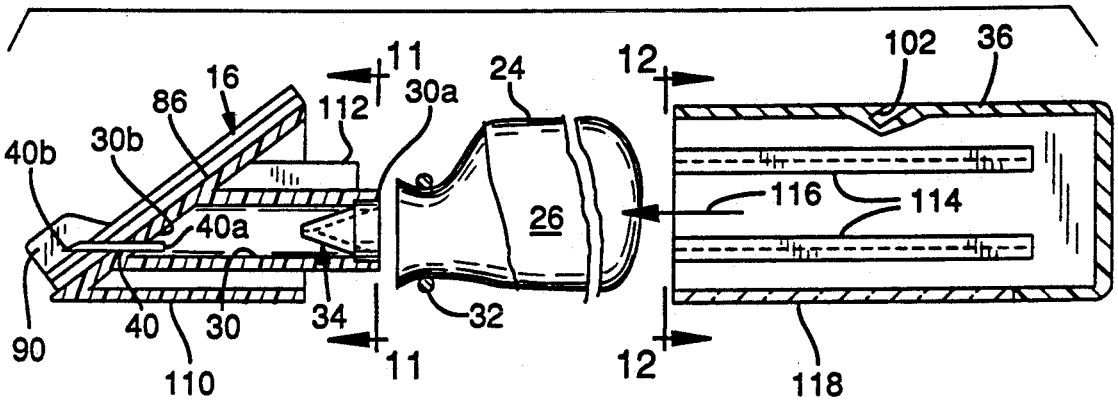
FIG. 10 is an exploded sectional view partially broken away of the media delivery portion of the air brush showing an airless media sack and a slidably mountable protective enclosure.
Figure 11:
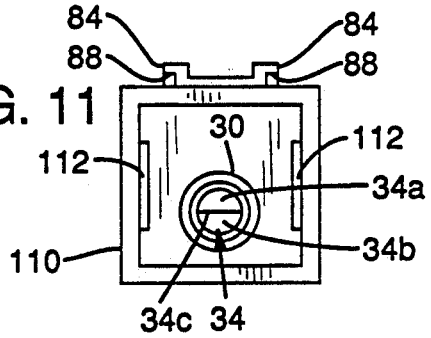
FIGS. 11 and 12 are sectional views of the media delivery portion of the air brush taken along lines 11—11 and 12—12, respectively, of FIG. 10.
Figure 12:
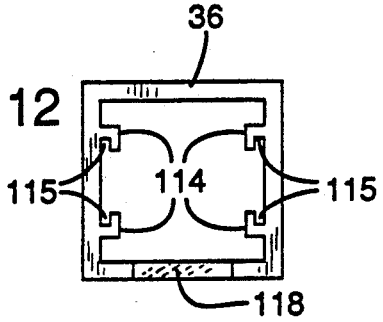

FIG. 10 is an exploded view of the media delivery portion 12 showing the mounting of media sack 24 upon the conduit 30 by O ring 32. FIGS. 11 and 12 are end views showing a nose portion and enclosure portion, respectively, of media delivery portion 12. In FIGS. 10–12, media delivery portion 12 includes a nose piece 110 which carries the coupling formation 16 and the conduit 30. Nose piece 110 further includes a pair of mounting plates 112. Enclosure 36 includes four L brackets 114 defining a pair of plate receiving formations 115, one on each side of the interior of enclosure 36. The plate receiving formations 115 of enclosure 36 accept the mounting plates 112 of nose piece 110 as enclosure 36 is slidably attached to nose piece 110 as indicated by the mounting arrow 116 of FIG. 10. Enclosure 36 also includes a window 118 for observing the condition of sack 24.

Figure 13:
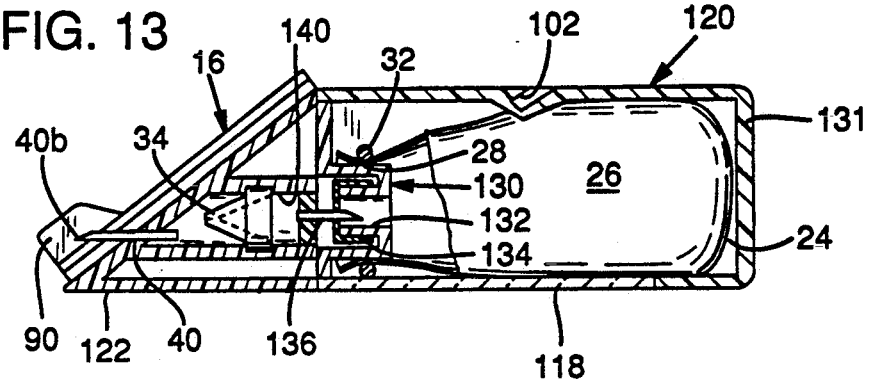
FIG. 13 is a sectional view, similar to that of FIGS. 6 and 7, of an alternative media delivery portion of the air brush.

FIG. 13 illustrates in section and partially cut away an alternative media delivery portion 120. In FIG. 13, media delivery portion 120 includes a coupling formation 16 upon a nose piece 122. Media delivery portion 120 is modified to include a sack 24 mounting structure 130 integral to an enclosure 131 whereby opening 28 of sack 24 mounts by O ring 32 on structure 130. A conduit 132 of structure 130 accepts media 26 directly from sack 24. The opposite end of conduit 132 is sealed by a closure membrane 134 for containing media 26 within the conduit 132 and sack 24. Nose piece 122 includes a protruding hollow needle 136 defining the inlet portion of a conduit 140. Needle 136 is positioned to penetrate the membrane 134 upon mounting of the enclosure 131 upon nose piece 122. One way valve 34 is positioned along the length of conduit 140. The media delivery portion 120 of FIG. 13 otherwise mounts upon and operates in conjunction with air delivery portion 14 as described above.

The media delivery portion 120 of FIG. 13 is advantageous in that a single nose piece 110 may be used for a number of media containing enclosures 131. The user of air brush 10 need only maintain an inventory of one or several such nose pieces 110 to support a larger inventory media containing of enclosures 131. Thus, as each media containing enclosure 131 is exhausted, the user need only mount a new enclosure 131 and discard the exhausted enclosure 131. In this manner, prepackaging of enclosures 131 for use in conjunction with preexisting nose pieces 122 reduces the manufacturing cost of providing prepackaged ink cartridges to the user.

Figure 14:
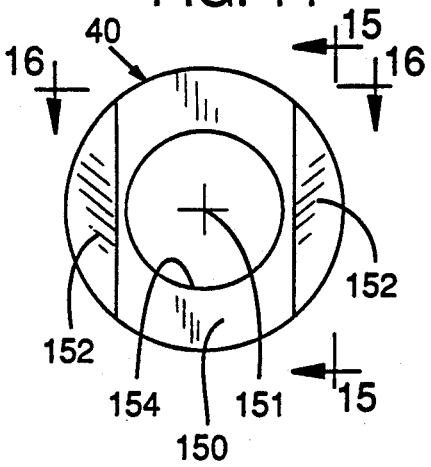
FIGS. 14–16 illustrate beveling of a media nozzle of the air brush for improved operation.
Figure 15:
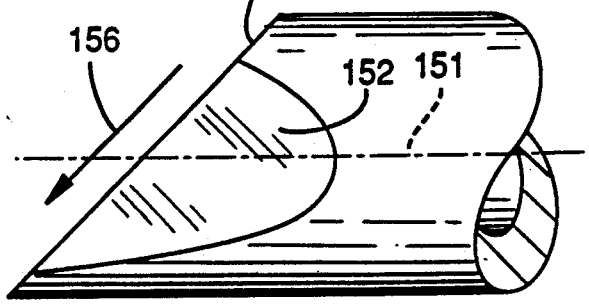
Figure 16:
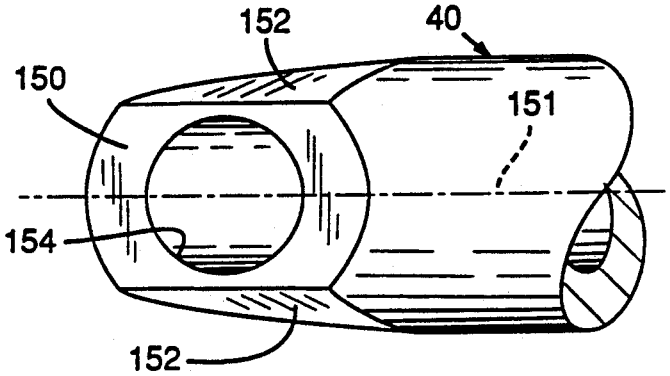

FIGS. 14–16 illustrate an improvement which may be applied to the nozzle 40 in order to minimize buildup of media thereon and provide a more uniform spray 23. In FIGS. 14–16, the distal surface 150 of nozzle 40 is at a 45 degree angle relative to the central longitudinal axis 151 of nozzle 40. Bevel surfaces 152 are ground on each side of the central aperture 154 of nozzle 40. In the particular embodiment shown, beveled surfaces 152 extend laterally outward at approximately 45 degrees relative to the surface 150. The surface 150 and beveled surfaces 152 lie generally parallel to the airflow 156 as provided by the air nozzle 78. In use, the beveled surfaces 152 prevent buildup of media at the opening of nozzle 40 between spraying steps. Without the beveled surfaces 152, media tends to collect at the end of nozzle 40 and then tends to eject from the air brush 10 in an undesirable fashion, speckling the work product, upon first actuating the spray button 22. With the beveled surfaces 152, however, the media tends to draw back within aperture 154 of nozzle 40 when the airflow 156 terminates. In this manner, the media is suitably atomized upon first actuation of spray button 22 and the undesirable expulsion of non-atomized media is avoided. Without the beveled surfaces 152, the user would be required to clear the air brush, e.g., spray off to the side of the work piece, prior to each actuation of spray button 22.

The beveled surfaces 152, in avoiding buildup of media at the tip of nozzle 40, also prevent premature drying of media at the tip of nozzle 40. Without the beveled surfaces 152, the buildup of media at the tip of nozzle 40 tends to dry more quickly than media held within nozzle 40. Accordingly, use of beveled surfaces 152 avoids such buildup of media exterior of nozzle 40 and thereby avoids premature drying of such media.

The particular configuration of nozzle 40 with respect to the angle of surface 150 and angle of beveled surfaces 152 with respect to surface 150 may vary. Thus, for variation in the diameter of nozzle 40, a greater or lesser angle of bevel for surfaces 152 with respect to 150 may be required according to the particular media to be discharged by air brush 10.

Figure 17:
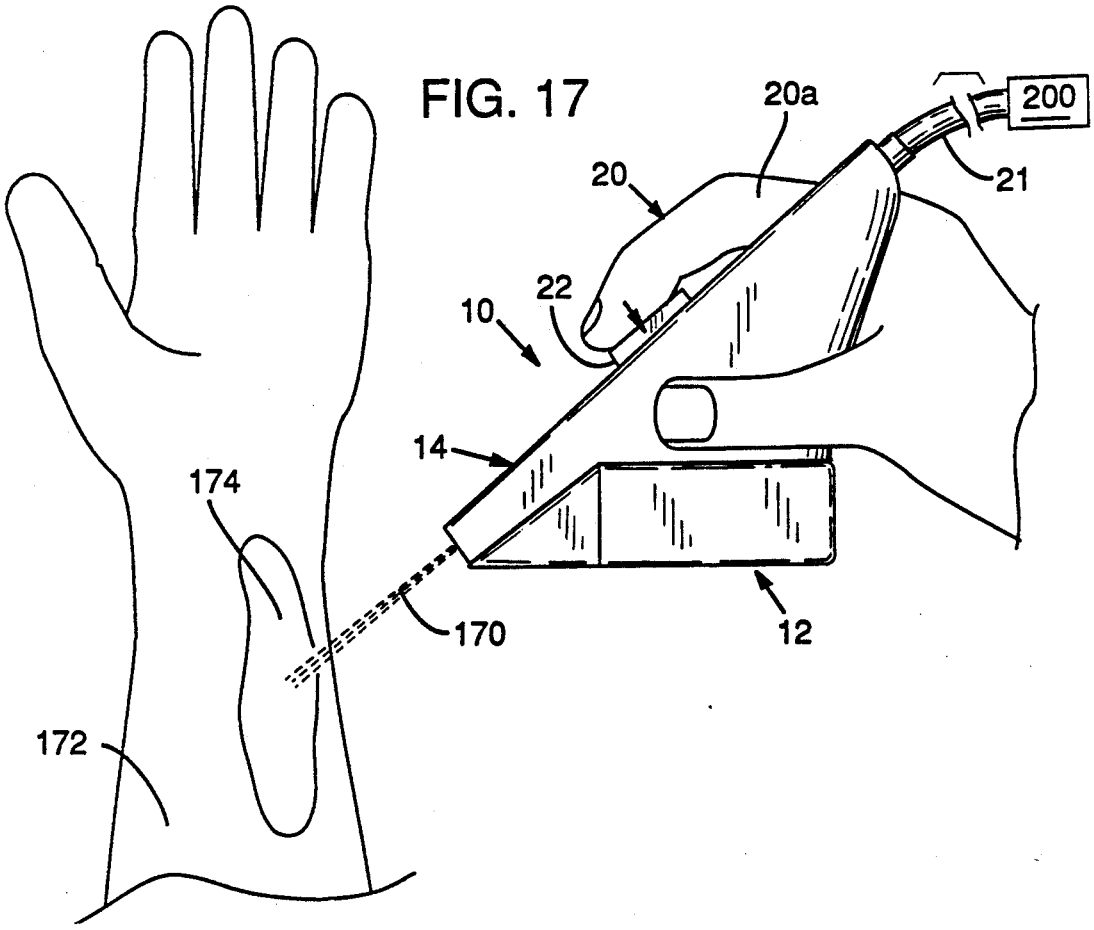
FIG. 17 illustrates a medical use of the air brush of the present invention to apply uniformly and in controlled fashion a medication to human tissue.

FIG. 17 illustrates another use of air brush 10. In FIG. 17, the air brush 10 is employed to spray a medication 170 on a patient's arm 172 having thereon a burn wound 174. The use of air brush 10 to apply the medication spray 170 is particularly useful in burn wounds because the medication can be applied uniformly and in a metered fashion, i.e., at specific volumes of delivery, and without requiring hand application. It will be understood, however, that medical use of air brush 10 is not limited to burn wounds. The medication spray 170 may be of a variety of types of medication including those for the loosening of dead skin, antibiotic or antiseptic functions, or as a sealing medication for establishing an artificial skin to promote healing of the burn wound 174. In such medical application of air brush 10, it is desirable to provide the media delivery portions 12 in a germ free condition. Thus, the media delivery portions 12 may be provided in presanitized hermetically sealed packaging whereby the media delivery portion 12 may be removed from such sanitary packaging just prior to its use. Also, it may be appreciated that the embodiment of FIG. 13 may be particularly useful in medical applications because the nose piece 122 may be maintained in a separate sanitary package while a variety of media delivery portions 120, each including a different type of or a different volume of medication, may be stored in separate sanitary packaging. Also, the embodiment of FIG. 13 may permit a greater degree of control over the volume of medication delivered to a wound. Thus, for example, a controlled volume of medication may be injected into the media delivery portion 120 by way of membrane 134 and the media delivery portion 120, having a specific volume of medication therein, may be mounted on the nose piece 120 for delivery to a wound site. In furtherance of the medical objectives of the embodiment of FIG. 17, it may be appreciated by those skilled in the medical arts that use of compressed air for atomizing the medication for delivery to the wound site 170 may not be the most desirable transport mechanism for the medication. Thus, the air hose 21 of the air brush 10 as shown in FIG. 17 is coupled to a compressed gas source 200. Source 200 represents a variety of suitable gas media for atomization and delivery of the medication to the wound site 174. Thus, the compressed gas source 200 could be a form of sanitized compressed air, or some other form of gas acceptable for application to the wound site 174 such as nitrogen and the like.

Thus, an improved air brush has been shown and described. The air brush is considerably less complicated and less expensive than conventional air brush devices. The air brush provides a self contained media cartridge including a nozzle, an airless media sack and, if needed, a one way valve between the sack and nozzle. The airless media sack and one way valve provide increased freedom of spray direction including horizontal and vertical spraying. The self contained media cartridge may be used without a one way valve for certain applications where limited spray direction is acceptable, e.g., for some art illustration applications. The one way valve also provides a means to meter the flow of media, providing back-pressure to hold media within the cartridge in the absence of air flow. In other applications, where horizontal and vertical spraying is desired, the one way valve facilitates continuous flow from the airless media sack to the media nozzle. The slide mounting of the media delivery portion upon the air delivery portion not only provides convenient attachment of the media delivery portion to the air delivery- portion, but also suitably positions the media nozzle adjacent the air nozzle for drawing media from the media sack and producing the desired media spray. The user can quickly switch between colors or media without cleaning portions of the air brush. The user frequently changing media, e.g., media colors or medication, thereby avoids intermediate cleaning and operates more efficiently. The manufacturer can provide prepackaged media delivery portions for use with pre-existing air delivery portions. In this regard, the user need not directly handle the ink media such as by filling air brush reservoirs and the like but may do so if desired.

It will be appreciated that the present invention is not restricted to the particular embodiment that has been described and illustrated, and that variations may be made therein without departing from the scope of the invention as found in the appended claims and equivalents thereof. For example, variation in compressed gas pressure, nozzle 40 and 78 diameters, and media 26 composition, e.g., viscosity, will vary the character of spray 23. Thus, several portions 12, e.g., shown in FIG. 1, having different nozzle 40 diameters or positioning relative to nozzle 78 may be available and selectively mounted for variation in spray 23. Also, while shown as an ink and medication media device, it may be appreciated that other media may be delivered by an air brush of the present invention such as in cosmetic applications. It will be further understood that the invention is not limited to use of compressed air, rather a variety of compressed gases may be used as alternatives, such as nitrogen in the embodiment of FIG. 17 for medical application. Furthermore, the media delivery portions 12 may be provided as a prepackaged prefilled product, or may be refillable by the user by, for example, removing bag 24 from conduit 30, filling bag 24 with a given media, and remounting bag 24 on conduit 30 with the O ring 32.

What is claimed is:

1. An air brush system comprising:

gas delivery means for providing a gas stream, said gas delivery means including a first coupling mechanism; and a plurality of media delivery means each having a media nozzle with a media nozzle outlet, each media delivery means adapted to deliver a selected media at its media nozzle outlet when precisely positioned within the gas stream provided by said gas delivery means to draw media therefrom as an atomized media spray, each of said media delivery means including a second coupling mechanism cooperative with said first coupling mechanism to define a self-positioning mounting arrangement to mount a selected media delivery means upon the gas delivery means while concurrently precisely positioning said media nozzle outlet within the gas stream according to predetermined registration therebetween to produce said media spray.

2. An air brush system according to claim 1 wherein at least one of said media delivery means comprises;

an airless media sack portion including a closure membrane sealing the media sack portion, said sack portion being collapsible; and a nose portion mountably receiving said media sack portion and including a protruding needle adapted for penetration of said closure membrane to allow passage of media from said airless media sack portion to said media nozzle outlet upon mounting of said sack portion upon said nose portion.

3. An air brush system according to claim 1 wherein each media delivery means comprises an airless media sack coupled to said media nozzle for containing media and delivering media to said media nozzle, each sack portion being collapsible.

4. An air brush system according to claim 3 wherein a one way valve is interposed between said media sack and said media nozzle for permitting media flow in a first direction from said sack to said nozzle and preventing flow in a second direction opposite said first direction.

5. An air brush system according to claim 1 wherein at least one of said media delivery means comprises:

a media sack for containing media and delivering media to said media nozzle, said sack portion being collapsible;

a nosepiece including a conduit and providing said media nozzle through a closed end of the conduit, an open end of the conduit being adapted for mounting of said media sack to receive media from said sack; and a protective enclosure mountable upon said nosepiece for enclosing said media sack as mounted upon said conduit.

6. An air brush system according to claim 1 wherein said gas delivery means comprises:

a gas nozzle having an outlet;

means for receiving compressed gas; and a valve coupling said compressed gas receiving means and said gas nozzle and adapted for manual actuation to deliver said gas stream at the outlet of said gas nozzle, said first coupling mechanism receiving said second coupling mechanism of a selected one of said media delivery means and positioning precisely the media nozzle outlet thereof adjacent said gas nozzle outlet for suitably dispersing media upon actuation of said valve.

7. An air brush system according to claim 1 wherein said media delivery means comprises an airless media sack collapsible upon dispersal of media therefrom.

8. An air brush system according to claim 1 wherein at least one of said media nozzles at said media nozzle outlet includes a first surface oriented at a first angle with respect to a longitudinal axis of said media nozzle, and first and second beveled surfaces each lying at a second angle with respect to said first surface, said predetermined registration placing said first surface substantially parallel to said gas stream.

9. An air brush system according to claim 8 wherein said first surface and said first and second beveled surfaces lie in planes substantially parallel to said gas stream.

10. An air brush system according to claim 1 wherein at least one of said selected media includes media taken from a group comprising media used in artistic applications and media used in medical applications.

11. An air brush comprising:

gas delivery means adapted for coupling to a gas source and selectively providing a gas stream;

media delivery means including a media nozzle outlet to provide media within said gas stream to draw media from said media delivery means and disperse said media in an atomized media spray when precisely positioned within said gas stream; and a coupling mechanism including a first portion attached to said gas delivery means and a second portion coupled to said media delivery means, said first and second portions cooperative define a self-positioning mounting arrangement to precisely mount said media delivery portion upon said gas delivery portion while concurrently and precisely positioning said media nozzle with respect to said gas stream according to a predetermined registration therebetween.

12. An air brush according to claim 11 wherein the precise positioning of said media nozzle within said gas stream by mounting of said media delivery means upon said gas delivery means substantially avoids media contamination of said gas delivery means by location of said coupling mechanism spaced from said media nozzle outlet whereby said media delivery means may be dismounted from said gas delivery means leaving said gas delivery means substantially free of said media.

13. An air brush according to claim 11 wherein said media delivery means comprises an airless media sack coupled to an outlet of a media nozzle, said media sack being collapsible.

14. An air brush according to claim 13 wherein said air brush includes a one way valve interposed between said media sack and said media nozzle to provide media flow in a first direction from said media sack to said media nozzle and prevent media flow in a second direction opposite of said first direction.

15. An air brush according to claim 11 wherein said media delivery means comprises:

a cartridge holding an airless media sack adapted to collapse upon dispersal of media from said media delivery means;

a media nozzle having an outlet and mounted on said cartridge and coupled to said media sack; and coupling means for mounting said cartridge upon said gas delivery means to precisely position said media nozzle outlet within said gas stream upon mounting of said cartridge.

16. An air brush according to claim 11 wherein said media delivery means comprises:

a media sack for containing media and delivering media to said media nozzle outlet, said sack being collapsible;

a nosepiece including a conduit and providing said media nozzle outlet through a closed end of the conduit, an open end of the conduit being adapted for mounting of said media sack to receive media from said sack; and a protective enclosure mountable upon said nosepiece for enclosing said media sack as mounted upon said conduit.

17. A media delivery cartridge for an air brush providing a gas stream, the cartridge comprising:

media containment means adapted for holding a body of media;

a media nozzle coupled to said media containment means for delivering media in response to placement of an outlet of said media nozzle within a gas stream; and mounting means for mounting said cartridge upon said air brush and precisely positioning said media nozzle within the gas stream provided by said air brush to disperse media from said containment means, said mounting means providing self positioning of said media nozzle with respect to said gas stream according to predetermined registration therebetween.

18. A cartridge according to claim 17 wherein said media containment means comprises:

an airless media sack adapted to collapse upon dispersal of media therefrom;

a closure membrane sealing said media sack; and a needle formation adapted for penetration of said closure membrane for coupling of said media containment means to said media nozzle.

19. A cartridge according to claim 17 wherein said media containment means comprises an airless media sack coupled to the outlet of said media nozzle and adapted to collapse upon dispersal of media therefrom.

20. A cartridge according to claim 19 wherein said cartridge includes a one way valve interposed between said media sack and said media nozzle to provide media flow in a first direction from said media sack to said media nozzle and prevent media flow in a second direction opposite said first direction.

21. A cartridge according to claim 17 wherein said cartridge comprises:

a protective enclosure;

an airless media sack as said containment means within said enclosure and adapted to collapse upon dispersal of media therefrom, the sack being collapsible upon dispersal of media therefrom, the media nozzle being coupled to said sack; and slide coupling means as said mounting means for slidably mounting said cartridge upon said air brush to position said media nozzle outlet precisely within the gas stream provided by said air brush upon mounting of said cartridge upon said air brush.

22. A cartridge according to claim 17 wherein said cartridge comprises:

a media sack as said containment means for containing media and delivering media to said media nozzle, said sack being collapsible upon dispersal of media therefrom;

a nosepiece including a conduit and providing said media nozzle through a closed end of the conduit, an open end of the conduit being adapted for mounting of said media sack to receive media from said sack; and a protective enclosure mountable upon said nosepiece for enclosing said media sack as mounted upon said conduit.

* * * * *